US005302113A

United States Patent [19]

Eichelberger et al.

[11] Patent Number: 5,302,113

[45] Date of Patent: Apr. 12, 1994

[54] METHOD FOR INSTALLATION OF FLARE PILOT THERMOCOUPLE

[75] Inventors: Norman D. Eichelberger, Port Allen, La.; Troy W. Vannatta, Chattanooga, Tenn.

[73] Assignee: The Dow Chemical Company, Midland, Mich.

[21] Appl. No.: 44,991

[22] Filed: Apr. 6, 1993

[51] Int. Cl.[5] ..... F23D 11/36

[52] U.S. Cl. ..... 431/155; 431/80; 431/202

[58] Field of Search ..... 431/202, 80, 154, 155

[56] References Cited

U.S. PATENT DOCUMENTS

| | | | |
|---|---|---|---|
| 2,335,471 | 11/1943 | Ashcraft | 431/80 |
| 2,474,547 | 6/1949 | Patch | 431/80 |
| 2,822,867 | 2/1958 | Sassmanhanses | 431/155 |

*Primary Examiner*—Carroll B. Dority

[57] ABSTRACT

A method for installing thermocouples on flare burner tip pilot assemblies from grade without discontinuing operation of the flare, comprising modifying the pilot assembly thermowell to accept a fitting, attaching a section of tubing and running to grade to act as a sleeve for a thermocouple and sliding a predetermined length of thermocouple into the sleeve at grade to the burner tip assembly.

4 Claims, 3 Drawing Sheets

METHOD FOR INSTALLATION OF FLARE PILOT THERMOCOUPLE

BACKGROUND OF THE INVENTION

This invention relates to monitoring pilot flames in flare systems typically used in the oil and chemical industries. It particularly relates to the installation and the replacement of thermocouples in these systems. The traditional method of monitoring pilot flame assemblies is to install a thermocouple at the top of a flare stack and to run electrical leads from the thermocouple to a transmitter or other control system at grade. In case of problems with the thermocouple or with the pilot flame, a warning signal would typically alert operations personnel of the problem.

A problem with this traditional method is the fact that thermocouples routinely burn out and need replacing and, even with redundant or back-up thermocouples installed, there comes a time for change out. With the onset of new and more strictly-enforced environmental regulations, operating a plant when the thermocouples are disabled constitutes a violation of the regulations as given for example in the U.S. Code of Federal Regulations, Title 40, Part 60.18 a-f, unless another device capable of monitoring the flame, such as a remote optical sensor, is in place. Since a plant shutdown is therefore generally required to change out a thermocouple used in the traditional method, as it is unsafe to be in the vicinity of the flare without its being disabled, investments have been made in video equipment and the like which are aimed at the flare tip to detect the presence of a pilot flame. These units, however, are very costly to purchase and maintain.

Another problem associated with changing out thermocouples is one of time. Many state environmental agencies' regulations require that upon loss of pilot flame indication that visual verification that the pilot flame is lit has to be made every 15 minutes and recorded in a log book. If it takes more than 15 minutes to verify that the flare pilot flame is lit then the plant has to be shut down in order to correct the situation. If the problem lies with the thermocouple then it is of importance to effect a change within the 15 minute period, if the visual verification cannot be made.

SUMMARY OF THE INVENTION

The present invention relates to a safe, economical, and efficient method of installing or replacing thermocouples in flare stack operations that greatly reduces or eliminates the problems associated with traditional methods. The thermocouple replacement is effected from ground level or grade level while maintaining operations, thereby eliminating safety and productivity concerns. Also, the changeout procedure is simple and fast as all the work entailed is performed at grade level. The invention relates to adapting a thermowell at a flare pilot flame location, usually at the top of the flare stack, to receive a pipe fitting; attaching one end of a length of tubing to the pipe fitting and then extending the tubing down to grade level thereby forming a sleeve or conduit. A thermocouple is then inserted into the tubing at grade and pushed up the tubing until the thermocouple tip passes through the fitting and into the thermowell. The lower end of the thermocouple is then secured to the bottom end of the tubing to keep the thermocouple locked in position. To replace the thermocouple at a later date, all that is required is to loosen the securing means, pull the thermocouple down through the tubing sleeve, and insert a new thermocouple through the tubing.

DETAILED DESCRIPTION OF THE INVENTION

The present invention relates to a method of installing or replacing thermocouples used to monitor pilot flames in flare systems as are typically used in oil and chemical processing operations. The method involves techniques that overcome or dramatically reduce safety and productivity concerns associated with traditional changeout methods.

Figure 1:
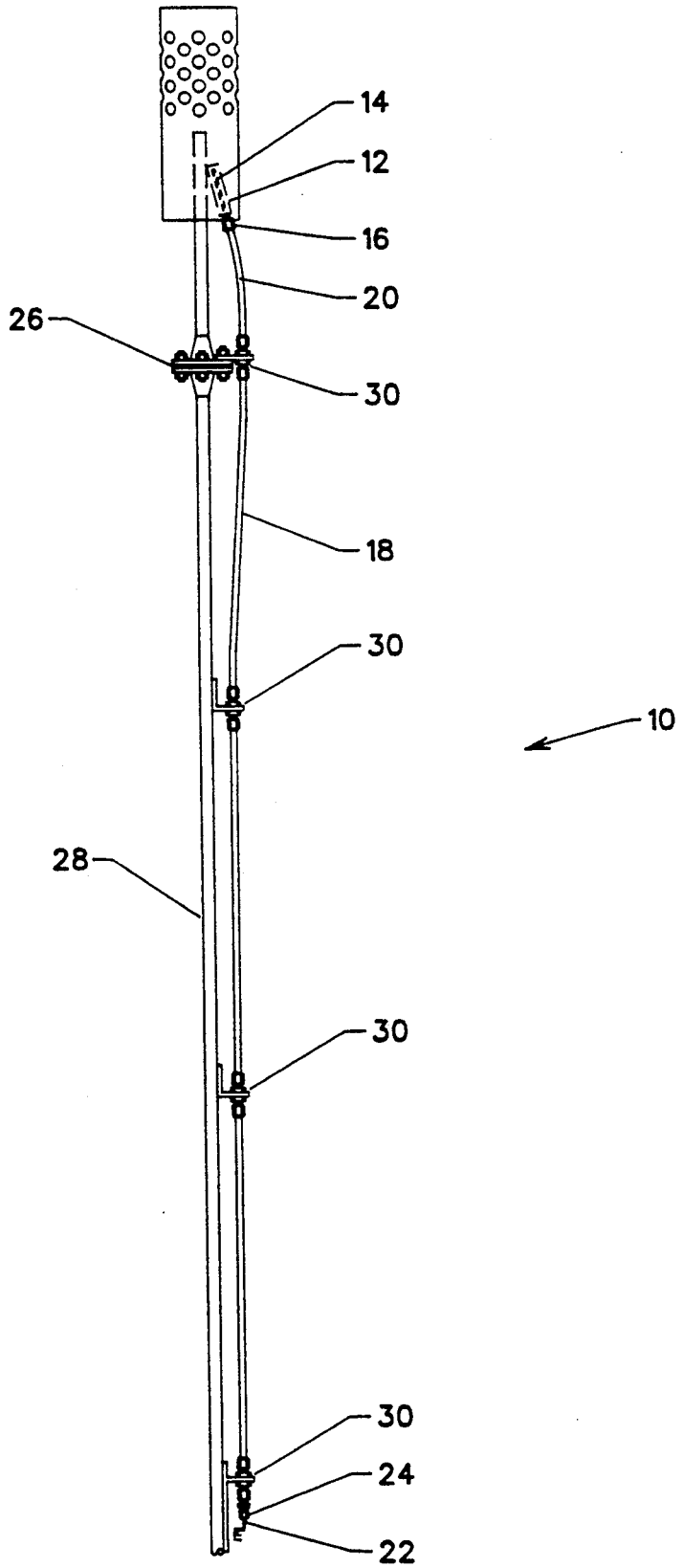
FIG. 1 is a front view, in schematic, of a pilot flare assembly having an associated grade-level changeable thermocouple which illustrates multiple lengths of tubing, having a thermocouple inside, extending downwardly from a thermowell. The tubing and thermowell are advantageously shown attached to a length of flare pilot gas piping.
Figure 2:
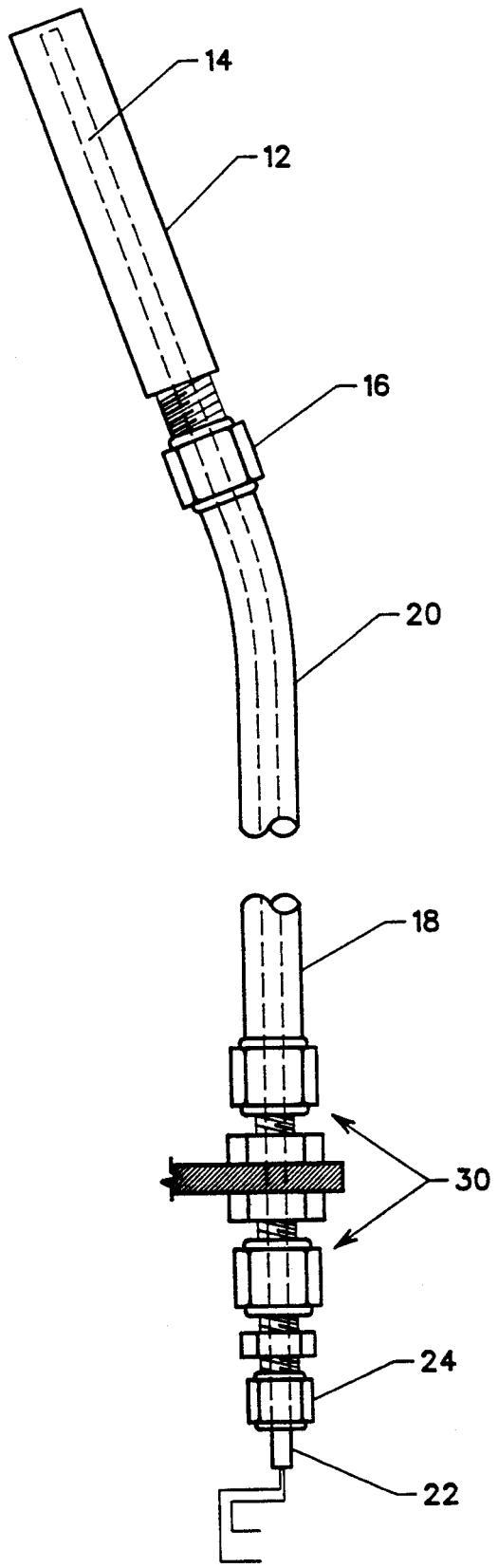
FIG. 2 is a pictorial view of the upper and lower portion of a grade-level changeable pilot flare thermocouple, mostly in schematic, which illustrates the thermocouple extending from inside the thermowell downwardly inside the tubing and extending downwardly through a compression fitting. The threaded fitting adaption at the thermowell is also illustrated.
Figure 3:
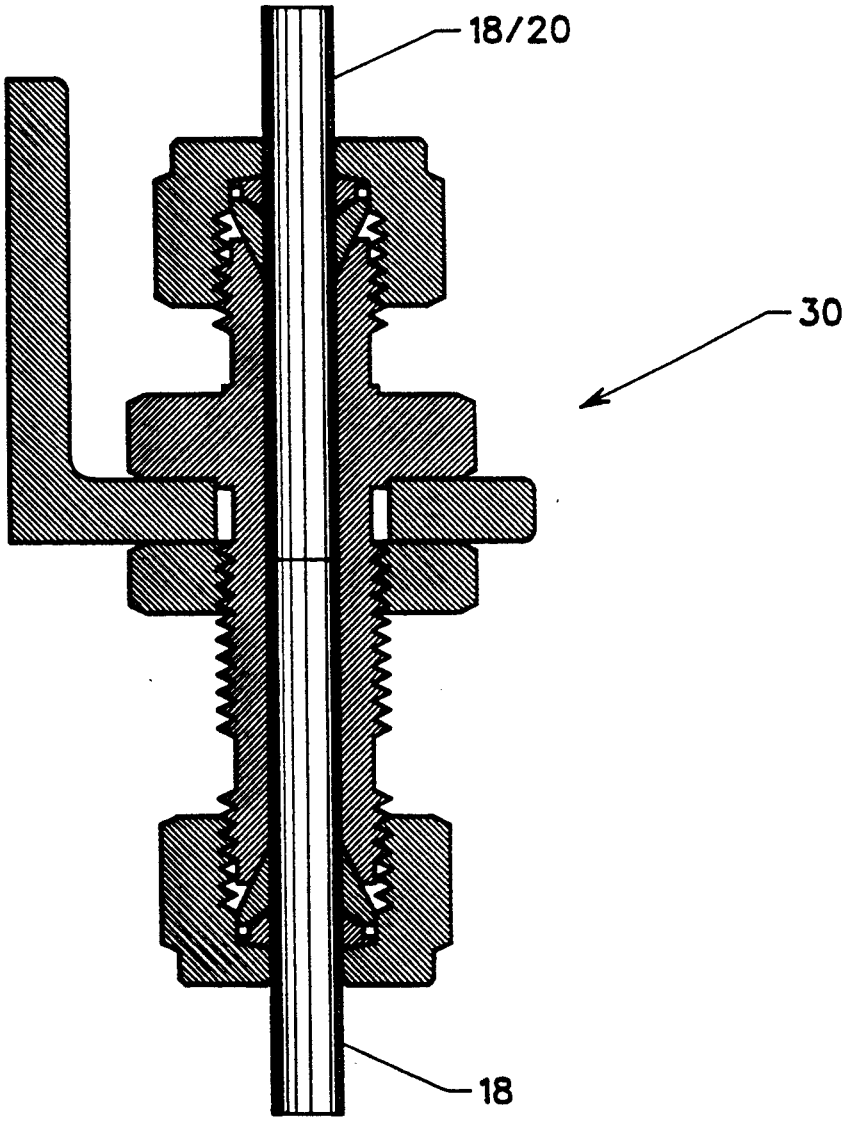
FIG. 3 is a cross section of a modified bulkhead tubing union showing the junction of two tubing sections inserted therein.

Referring to the drawings, in one embodiment of the invention, a thermowell 12, used to house the heat sensing tip 14 of a thermocouple 22, and located at the flame end of a pilot flare assembly 10, is drilled and tapped to accept the male end of a threaded tube fitting 16 such as a $\frac{1}{2}'' \times \frac{1}{4}''$ NPT tube connector, having an internal diameter throughout its length the same as the outside diameter of tubing 18, 20. To this fitting 16, a section of high heat resistant tubing 20 is attached and with appropriate couplings 30, such as bulkhead tubing unions, additional tubing sections 18 are added until the tubing 18, 20 reaches grade level. As shown in FIG. 3, these tubing unions are modified to have internal shoulders and stops removed to allow for uninterrupted passage of tubing 18, 20. The tubing 18, 20 acts as a sleeve for a thermocouple 22, the inner diameter of the tubing 18, 20 being larger than the outer diameter of the thermocouple 22 to be utilized. In this first embodiment, the diameter of the tubing 18, 20 is $\frac{1}{2}''$. The distance from the thermowell 12 to grade is measured and a 5/16" thermocouple 22 of at least the same length is obtained. The thermocouple 22 is inserted into the lower end of the tubing 18, 20 and pushed up the tubing 18, 20 until the thermocouple tip 14 engages the thermowell 12. Then the thermocouple 22 is secured to the grade end of the tubing 18, 20 by means of a compression fitting 24. The tubing 18, 20 acts as a sleeve for the thermocouple 22 and the compression fitting 24 serves to keep the thermocouple 22 in the thermowell 12. In a preferred embodiment the thermowell 12 is affixed to the flare gas pipeline 28 as shown in FIG. 1 and, the upper section 20 of the sleeve is manufactured from a high temperature-resistant alloy, such as INCONEL® 600, a nickel, chromium iron material produced by Inco Alloys International, Huntington, W. Va. and the thermocouple 22 is sheathed with a stainless steel jacket, such as Stainless Steel 316 or a high temperature resistant alloy, such as Inconel 600.

To replace a flare pilot flame thermocouple 22 originally installed using an embodiment of the invention, it is convenient to reverse the order of the installation. This is readily accomplished by disconnecting the thermocouple 22 from compression fitting 24 at the grade-level end of the tubing 18 and pulling the thermocouple 22 downward until it is clear of the tubing 18. Then, a replacement thermocouple 22 is pushed upwardly through tubing 18, 20 until the thermocouple tip 14 engages the thermowell 12. The thermocouple 22 is then secured to the grade end of the tubing 18, 20 by means of a compression fitting 24.

What is claimed is:

1. A method for installing a flare pilot thermocouple assembly comprising the steps of:

a. adapting a pilot flare thermowell to accept a tube fitting;

b. attaching one end of a length of tubing to said fitting the other end of said tubing being located at a predetermined grade level, said tubing forming a sleeve;

c. inserting a thermocouple into said sleeve at grade;

d. pushing said thermocouple upwardly within said sleeve to the tip of said thermowell; and e. securing said thermocouple to said other end of said sleeve.

2. A method as in claim 1 wherein the upper portion of said sleeve is manufactured from a high temperature resistant material.

3. A method as in claim 2 wherein said thermocouple is compressively attached to said sleeve.

4. A method for replacing a flare pilot thermocouple located in a thermowell having a tip located at a flare pilot at one end and extending through a tubing forming a sleeve attached at the thermowell at the one end and to a compression fitting at an opposite grade-level end comprising the steps of:

a. disconnecting said thermocouple from said compression fitting at the grade-level end of said tubing;

b. pulling said thermocouple downwardly within said sleeve until said thermocouple exits said tubing.

c. inserting a thermocouple into said sleeve at grade;

d. pushing said thermocouple upwardly within said sleeve to the tip of said thermowell; and e. securing said thermocouple to said other end of said sleeve.

* * * * *